US007832558B2

(12) United States Patent
Cheng et al.

(10) Patent No.: US 7,832,558 B2
(45) Date of Patent: Nov. 16, 2010

(54) PACKAGING CUSHION

(75) Inventors: Sheng-Hsiung Cheng, Taipei Hsien (TW); Te-An Lin, Taipei Hsien (TW); Wu-Nan Wang, Taipei Hsien (TW); Chia-Chia Huang, Taipei Hsien (TW)

(73) Assignee: Aopen Inc., Taipei Hsien (TW)

( * ) Notice: Subject to any disclaimer, the term of this patent is extended or adjusted under 35 U.S.C. 154(b) by 260 days.

(21) Appl. No.: 11/849,739

(22) Filed: Sep. 4, 2007

(65) Prior Publication Data

US 2008/0000789 A1 Jan. 3, 2008

(30) Foreign Application Priority Data

Nov. 6, 2006 (TW) ..... 95140973 A

(51) Int. Cl.
*B65D 85/00* (2006.01)
*B65D 5/50* (2006.01)

(52) U.S. Cl. ..... 206/320; 206/523; 206/521

(58) Field of Classification Search ..... 206/320, 206/523, 586, 588, 521, 591, 594, 784; 229/177, 229/178, 179, 167
See application file for complete search history.

(56) References Cited

U.S. PATENT DOCUMENTS 1,792,627 A * 2/1931 Bowersock ..... 206/591
2,963,210 A * 12/1960 Gillmore, Sr. ..... 229/178
3,701,465 A * 10/1972 Richter ..... 206/521
3,887,126 A * 6/1975 Wilson ..... 206/518
3,890,762 A * 6/1975 Ernst et al. ..... 53/440
4,339,039 A * 7/1982 Mykleby ..... 206/523
4,441,451 A * 4/1984 Neal ..... 119/168
5,328,090 A * 7/1994 Hanlon ..... 229/171
6,530,480 B1 * 3/2003 Hardy ..... 206/586

* cited by examiner

*Primary Examiner*—Mickey Yu
*Assistant Examiner*—Steven A. Reynolds
(74) *Attorney, Agent, or Firm*—Stephen A. Bent; Foley & Lardner LLP

(57) ABSTRACT

A paperboard includes a rectangular main portion, and first and second foldable extension parts respectively extending from four sides of the main portion. The main portion is divided by fold lines to form a first region and two second regions on two sides of the first region. The paperboard is foldable to form a first packaging configuration in which a four-sided surrounding wall extends upright from the first region, or a second packaging configuration in which one side of the four-sided surrounding wall is unfolded. A plurality of soft plates are respectively provided on the first region, and four sides of the surrounding wall for cushioning purposes.

11 Claims, 8 Drawing Sheets

PACKAGING CUSHION

CROSS-REFERENCE TO RELATED APPLICATION

This application claims priority of Taiwanese Application No. 095140973, filed on Nov. 6, 2006.

BACKGROUND OF THE INVENTION

1. Field of the Invention

The invention relates to a packaging cushion, more particularly to a packaging cushion for use in packaging electronic products, such as computer modules, or computer housings.

2. Description of the Related Art

Currently, most electronic products are manufactured through division of labors wherein various components made by different OEMs (original equipment manufacturers) are assembled in an assembly factory into final products for sale. For example, in manufacturing computer modules, computer components (including computer housings, main boards, power modules, electronic cards, disc drives, etc.) are first manufactured in different factories, and are then assembled into computer modules in an assembly factory. Because the production sites where the components are manufactured and assembled can be in different cities or even in different countries, the costs of transportation from a place of manufacture to a place of assembly could constitute an important part of the manufacturing costs.

In order to reduce transportation costs, computer components, such as computer housings, that occupy extra space, are provided with modular or foldable designs so that the quantity of computer components that can be carried in a single cargo container can be increased. However, computer housings must be accompanied by packaging materials, such as paper boxes, Styrofoam, etc., when delivered from manufacturing factories so as to facilitate packaging of the assembled computer modules for delivery to sales points or end users. When packaging materials are also sent from the place of manufacture to the place of assembly, Styrofoam cushion bodies that are commonly used as packaging materials also have the problem of consuming substantial space.

Referring to FIG. 1, Styrofoam cushion bodies 92, 93 used to cushion a computer module 91 are shaped as trays and embrace front and rear ends 911, 912 of the computer module 91. Because the shapes of the cushion bodies 92, 93 are fixed and because a large space is formed between the peripheral portions 921, 931 of the cushion bodies 92, 93, when a number of computers packaged as such are stacked in a cargo container, a lot of space within the cargo container are wasted and cannot be used efficiently.

Therefore, there is a demand for cushion bodies that can be laid flat for the purpose of saving transportation space and that can be changed into a packaging configuration during use.

SUMMARY OF THE INVENTION

Therefore, the main object of the present invention is to provide a packaging cushion that can be fully laid flat and that can also be changed into a packaging configuration during use.

Another object of the present invention is to provide a packaging cushion assembly that includes the aforesaid packaging cushion.

According to this invention, a packaging cushion comprises a foldable paperboard that includes a main portion, two first extension parts, two second extension parts, and four wings.

The main portion is substantially rectangular and has a set of substantially parallel first sides, a set of substantially parallel second sides, two opposite first and second faces, an imaginary first reference line substantially parallel to the first sides and passing through a geometric center of the main portion, an imaginary second reference line substantially parallel to the second sides and passing through the geometric center of the main portion. The first face has two first fold lines disposed in parallel to and respectively on two sides of the first reference line and spaced apart from the first reference line substantially by equal distances, two second fold lines each extending in parallel to and between one of the first sides and one of the first fold lines and proximate to the respective one of the first sides, two third fold lines each extending between one of the first fold lines and one of the second fold lines and proximate to the respective one of the second fold lines, a first region defined between the first fold lines, and two second regions each defined between one of the first fold lines and one of the first sides.

The two first extension parts extend respectively from the first sides in a direction substantially parallel to the second reference line, and each have two first short sides substantially parallel to the second reference line, and a first long side interconnecting free ends of the first short sides. The first short sides are offset from extension lines of the second sides of the main portion by a distance so that the first long side has a length smaller than that of the first sides of the main portion.

The two second extension parts extend respectively from portions of the second sides between the first fold lines in a direction substantially parallel to the first reference line, and each have two second short sides substantially parallel to the first reference line.

Each of the four wings extends from one of the second short sides in a direction substantially parallel to the second reference line, and has a third short side substantially parallel to the first reference line and opposite to the respective one of the second short sides, a third side spaced apart from an adjacent one of the second sides by a clearance, and a fourth side opposite to the third side.

The soft plates are respectively attached to the first extension parts, the second extension parts, and the first region of the main portion.

The packaging cushion can be formed into a first packaging configuration in which the second extension parts are bent by right angle toward the first face and along said second sides, the wings are bent by right angle along the second short sides to extend respectively along directions of the first fold lines, the second regions together with the first extension parts are bent by right angle toward the first face along the first fold lines, and the first extension parts together with parts of the main portion are bent by 180 degree along the second and third fold lines so that two of the wings are placed between a respective one of the first extension parts and a respective one of the second regions.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
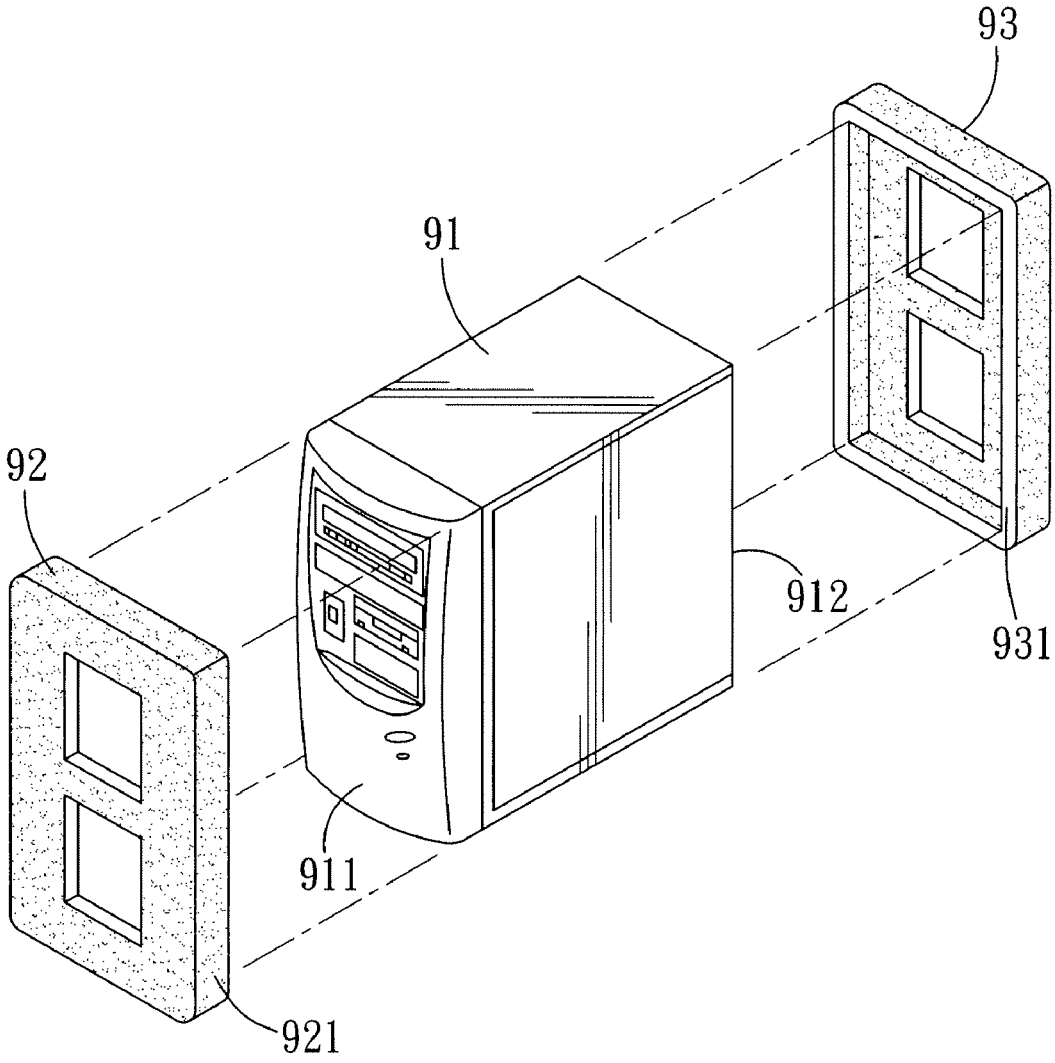
FIG. 1 PRIOR ART
FIG. 1 is a schematic view illustrating conventional packaging cushions and a computer module.

Before the present invention is described in greater detail, it should be noted that like elements are denoted by the same reference numerals throughout the disclosure.

Figure 2:
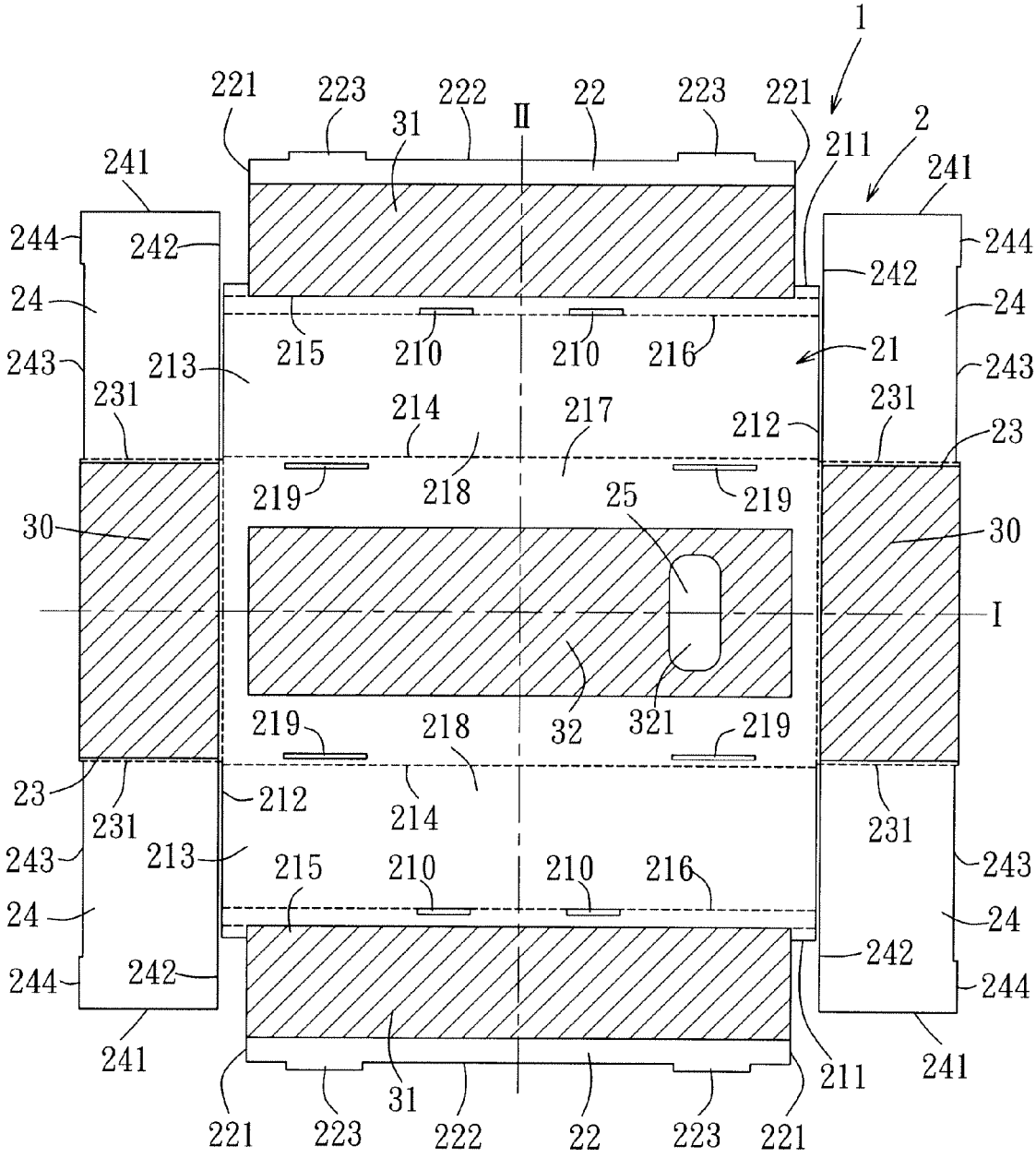
FIG. 2 is a schematic view of a packaging cushion according to a first preferred embodiment of the present invention, the packaging cushion being in an unfolded state.

Referring to FIG. 2, there is shown a packaging cushion 1 according to the first preferred embodiment of the present invention in an unfolded state. The packaging cushion 1 is suitable for use in packaging a computer housing, and includes a foldable paperboard 2, and a plurality of soft plates 30, 31, 32 made of Styrofoam and attached to the paperboard 2.

The paperboard 2, in the unfolded state, includes a main portion 21, two first extension parts 22, two second extension parts 23, and four wings 24. The main portion 21 is substantially rectangular and has a pair of substantially parallel first sides 211 and a pair of substantially parallel second sides 212, and a first face 213 and a second face (not shown) that are opposite to each other. The main portion 21 has an imaginary first reference line (I) that passes through the geometric center of the main portion 21 and that is substantially parallel to the first sides 211, and an imaginary second reference line (II) that passes through the geometric center of the main portion 2 and that is substantially parallel to the second sides 212. The first face 213 has two first fold lines 214 that are provided at two sides of the first reference line (I) and that are spaced apart from the first reference line (I) by equal distances, two second fold lines 215 each of which is disposed in parallel to and between the respective first side 211 and the respective first fold line 214 and each of which is proximate to the respective first side 211, and two third fold lines 216 each of which is disposed in parallel to and between the respective first fold line 214 and the respective second fold line 215 and each of which is proximate to the respective second fold line 215. The main portion 21 further has a first region 217 between the two first fold lines 214, and two second regions 218 each of which is defined by the respective first fold line 214 and the respective first side 211.

Each first extension part 22 extends horizontally from the respective first side 211 in a direction parallel to the second reference line (II). Each first extension part 22 has two first short sides 221 substantially parallel to the second reference line (II), and a first long side 222 connected to the free ends of the two first short sides 221. The two first short sides 221 are offset from extension lines of the adjacent second sides 212 by a distance so that the first long side 222 has a length smaller than that of the first side 211. Each first long side 222 is provided with two first tabs 223. The first region 217 of the main portion 21 is formed with four first insert slots 219 to match the first tabs 223 of the two first extension parts 22. Each first tab 223 can be engaged in one of the first insert slots 219.

Each second extension part 23 extends horizontally from a portion of the respective second side 212 between the two first fold lines 214 in a direction parallel to the first reference line (I), and has two second short sides 231 substantially parallel to the first reference line (I).

Each wing 24 extends horizontally from the respective second short side 231 in a direction parallel to the second reference line (II), and has two third short sides 241 parallel to the first reference line (I), a third side 242 spaced apart from the adjacent second side 212 by a clearance, and a fourth side 243 opposite to the third side 242. The fourth side 243 of each wing 24 is formed with a second tab 244 proximate to the adjacent third short side 241. Each second region 218 of the main portion 21 is provided with two second insert slots 210 between the respective second and third fold lines 215, 216 to match respectively the second tabs 244. Each second tab 244 can be engaged in a respective one of the second insert slots 210.

The first, second and third short sides 221, 231, 241 of the paperboard 2 have a length that is substantially equal to a distance between the first fold line 214 and the third fold line 216 of each second region 218 of the main portion 21, and cooperate with each other to form a four-sided surrounding wall 11 of the packaging cushion 1.

Five elongated soft plates 30, 31, 32 are respectively provided on the first and second extension parts 22, 23, and the first region 217 of the main portion 21. The soft plates 30, 31, 32 are adhered to the paperboard 2 using glue and are all provided on the same face of the paperboard 2. The soft plate 31 disposed on each of the first extension parts 22 has a portion extending to the main portion 21 and contacting the respective second fold line 215. The soft plate 32 of the main portion 21 is disposed at a central part of the first region 217. The main portion 21 and the soft plate 32 are respectively provided with a handling hole 25 and a through hole 321 which are communicated with each other and which can be used by the user to hold the packaging cushion 1. Note that the arrangement of the soft plates 30, 31, 32 should not be limited to the aforesaid surface of the paperboard 2 to which the soft plates 30, 31, 32 are attached as shown in FIG. 2, and the soft plates 30, 31, 32 may also be attached to the opposite other face of the paperboard 2.

Figure 3:
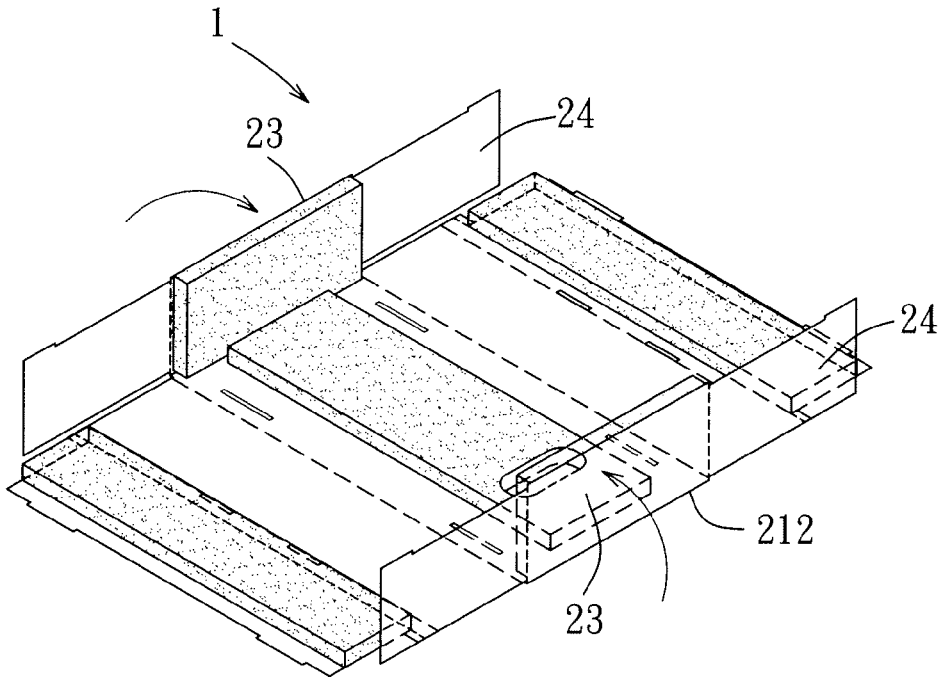
FIGS. 3-6 illustrate a sequence of steps for folding the packaging cushion of FIG. 2 so as to convert the packaging cushion from the unfolded state to a first packaging configuration.
Figure 4:
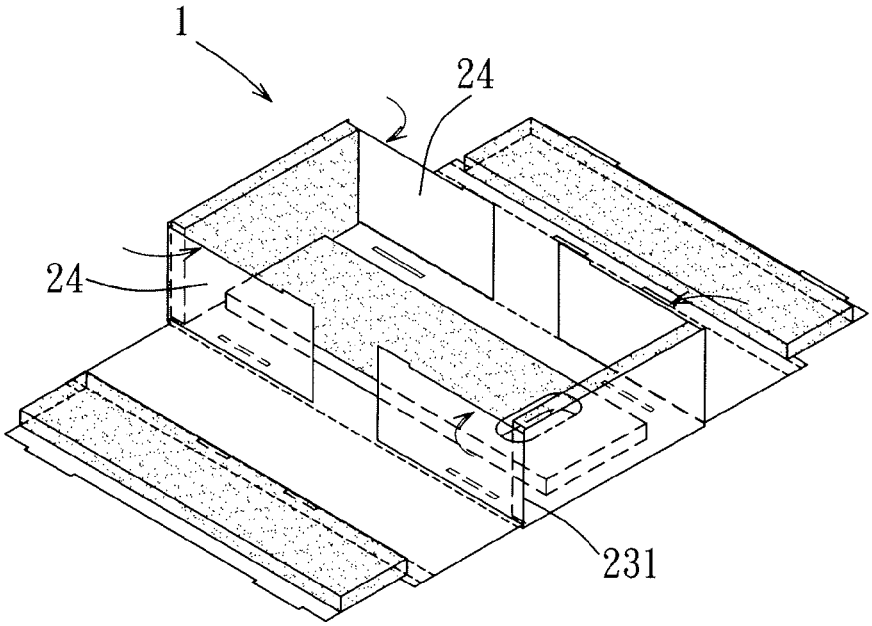
Figure 5:
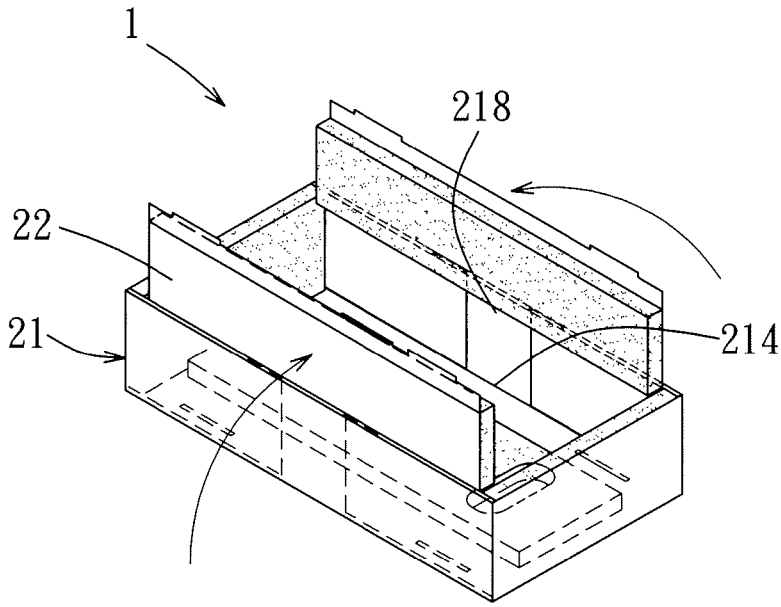
Figure 6:
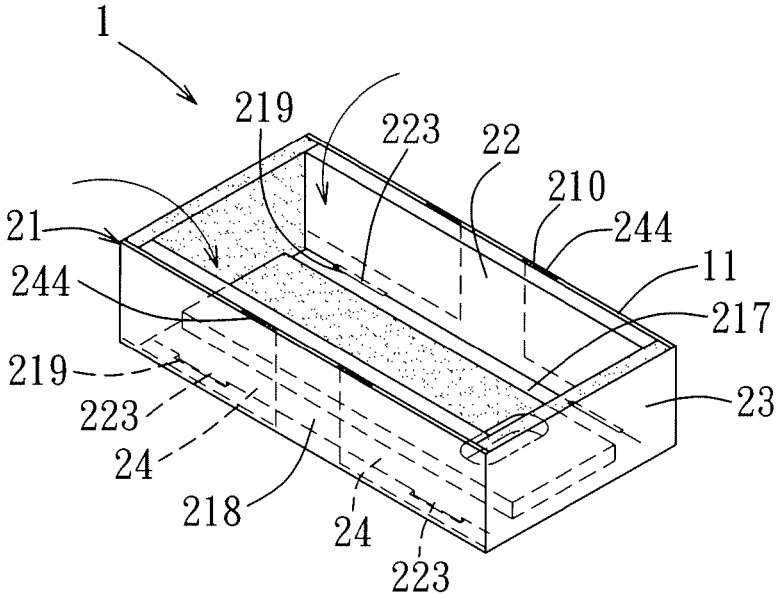

Referring to FIG. 3, when the packaging cushion 1 is to be formed into a first packaging configuration, the second extension parts 23 may be firstly bent along the respective second sides 212 so that the second extension parts 23 and the wings 24 extend upright (see the directions shown by arrows). Thereafter, the wings 24 are bent at right angle in opposite directions along the respective second short sides 231 as shown in FIG. 4. Referring to FIG. 5, the second regions 218 of the main portion 21, together with the first extension parts 22, are folded upward at right angle along the respective first fold line 214 (see the directions shown by arrows). Referring to FIG. 6 in combination with FIG. 2, the first extension parts 22, together with parts of the main portion 21, are folded substantially by an angle of about 180° along the respective second fold lines 215 and the respective third fold lines 216 so that two wings 24 are sandwiched by one of the first extension parts 22 and one of the second regions 218 of the main portion 21. The second tabs 244 are engaged in the second insert slots 210, respectively, whereas the first tabs 223 are engaged in the respective first insert slots 219. As a result, the first and second extension parts 22, 23 are fixed in the positions perpendicular to the first region 217 of the main portion 21, forming the surrounding wall 11 of the packaging cushion 1 in a first packaging configuration. The surrounding wall 11 cooperates with the first region 217 of the main portion 21 so that the packaging cushion 1 has the tray-like first packaging configuration.

Figure 7:
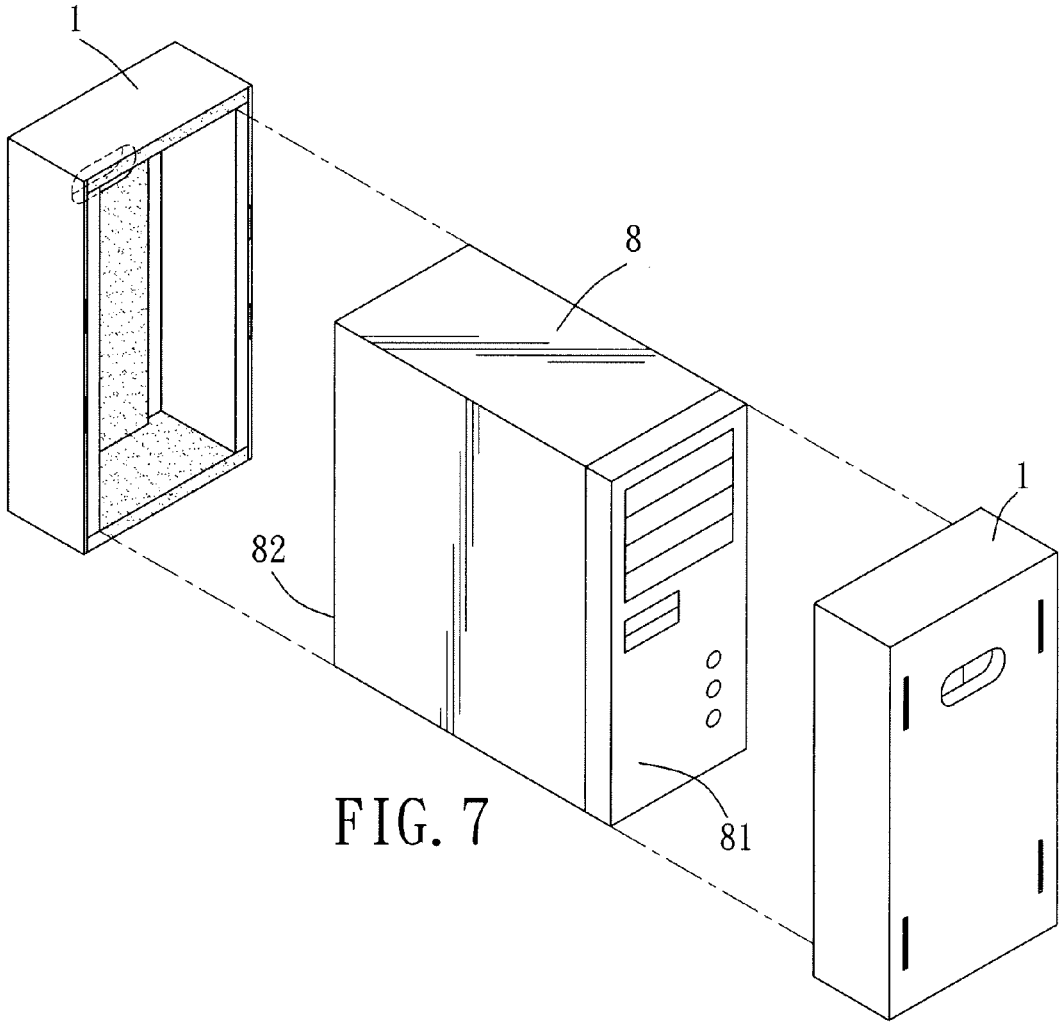
FIG. 7 is a schematic view illustrating two packaging cushions of the first preferred embodiment which are in the first packaging configuration to package a computer housing.

Referring to FIG. 7, there is shown two packaging cushions 1 in the first packaging configurations that are used to embrace respectively a front panel side 81 and a rear side 82 of a computer housing 8 for the protection of the computer housing 8.

Figure 8:
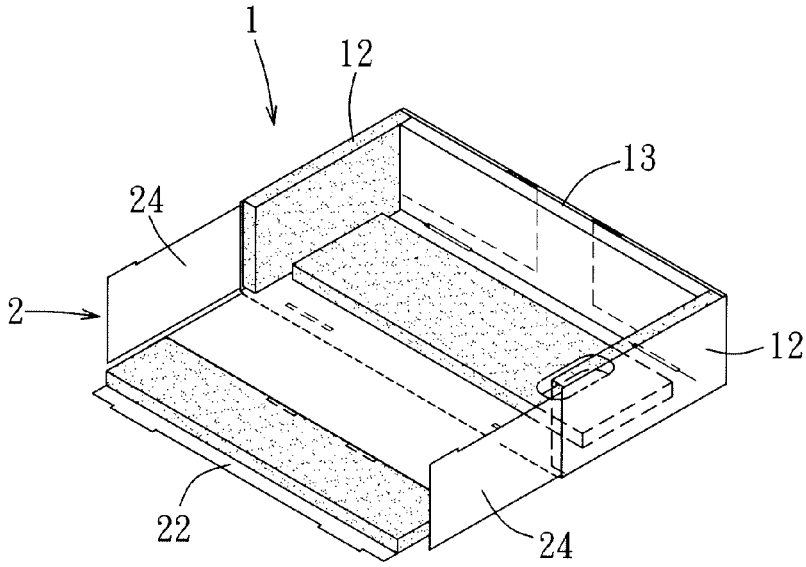
FIG. 8 is a schematic view showing a second packaging configuration of the packaging cushion of the first preferred embodiment.
Figure 9:
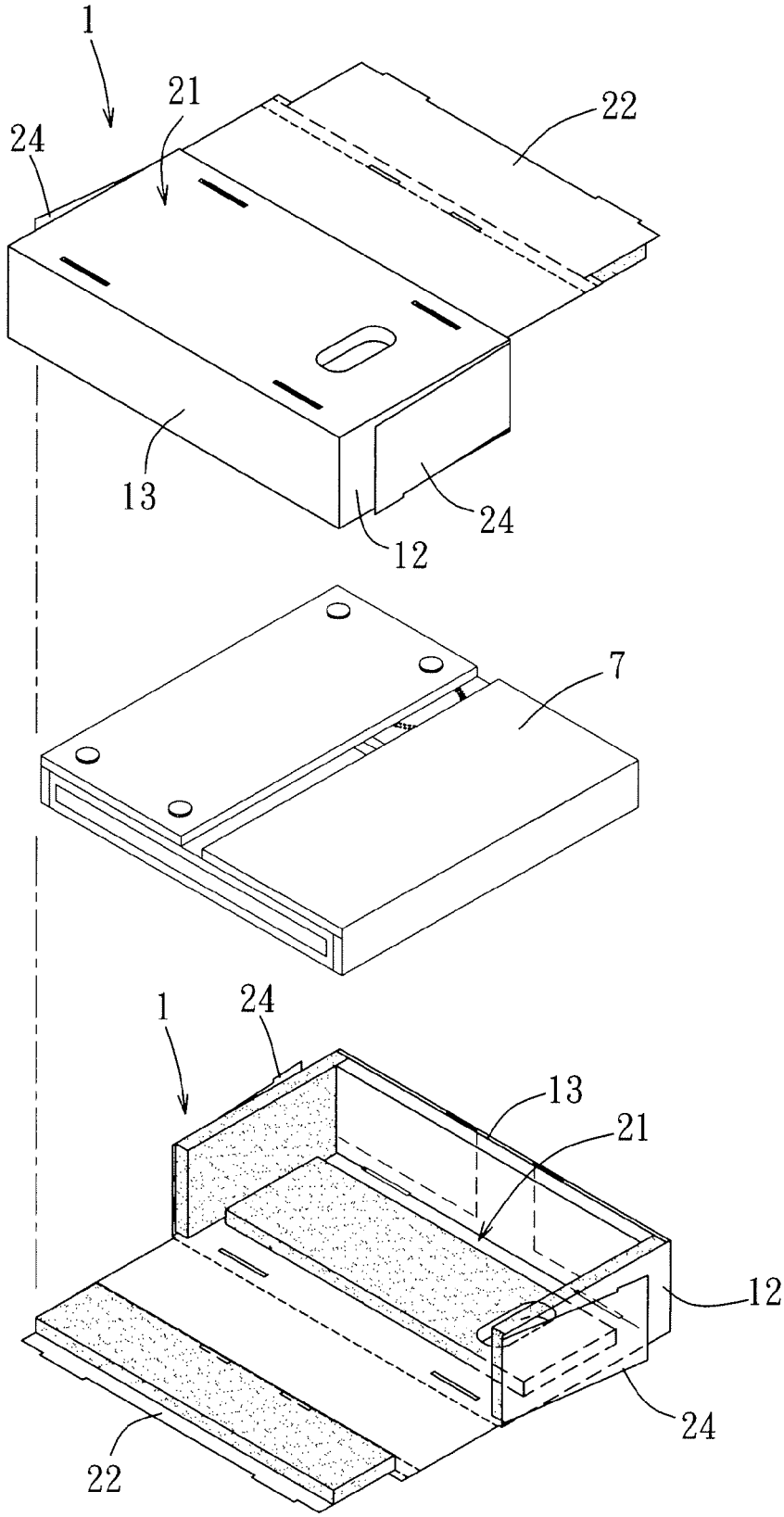
FIG. 9 is a schematic view illustrating two packaging cushions of the first preferred embodiment which are in the second packaging configuration to package a folded computer housing.

Referring to FIG. 8, the packaging cushion 1 according to the present invention is formed into another configuration (a second packaging configuration) having a single unfolded side. That is to say, one of the first extension parts 22 of the paperboard 2 is laid flat and is unfolded so that there are two short sidewalls 12 and a long sidewall 13. Referring to FIG. 9, two packaging cushions 1 are placed one over the other. The upper packaging cushion 1 is inverted and has its unfolded first extension part 22 extending rightwards, whereas the lower packaging cushion 1 has its unfolded extension part 22 extending leftwards. After the two packaging cushions 1 are assembled, the two short sidewalls 12 of the packaging cushions 1 abut against each other and cooperate with the long sidewalls 13 to form a complete surrounding wall 11. Furthermore, the main portions 21 and the unfolded parts of the two packaging cushions 1 form upper and lower walls for the surrounding wall so that a containing space is formed to receive a collapsed or folded computer housing 7. At this state, the wings 24 of the two packaging cushions 1 are bent outward by an angle of 180 deg. so that the adjacent wings 24 will not interfere with each other.

Figure 10:
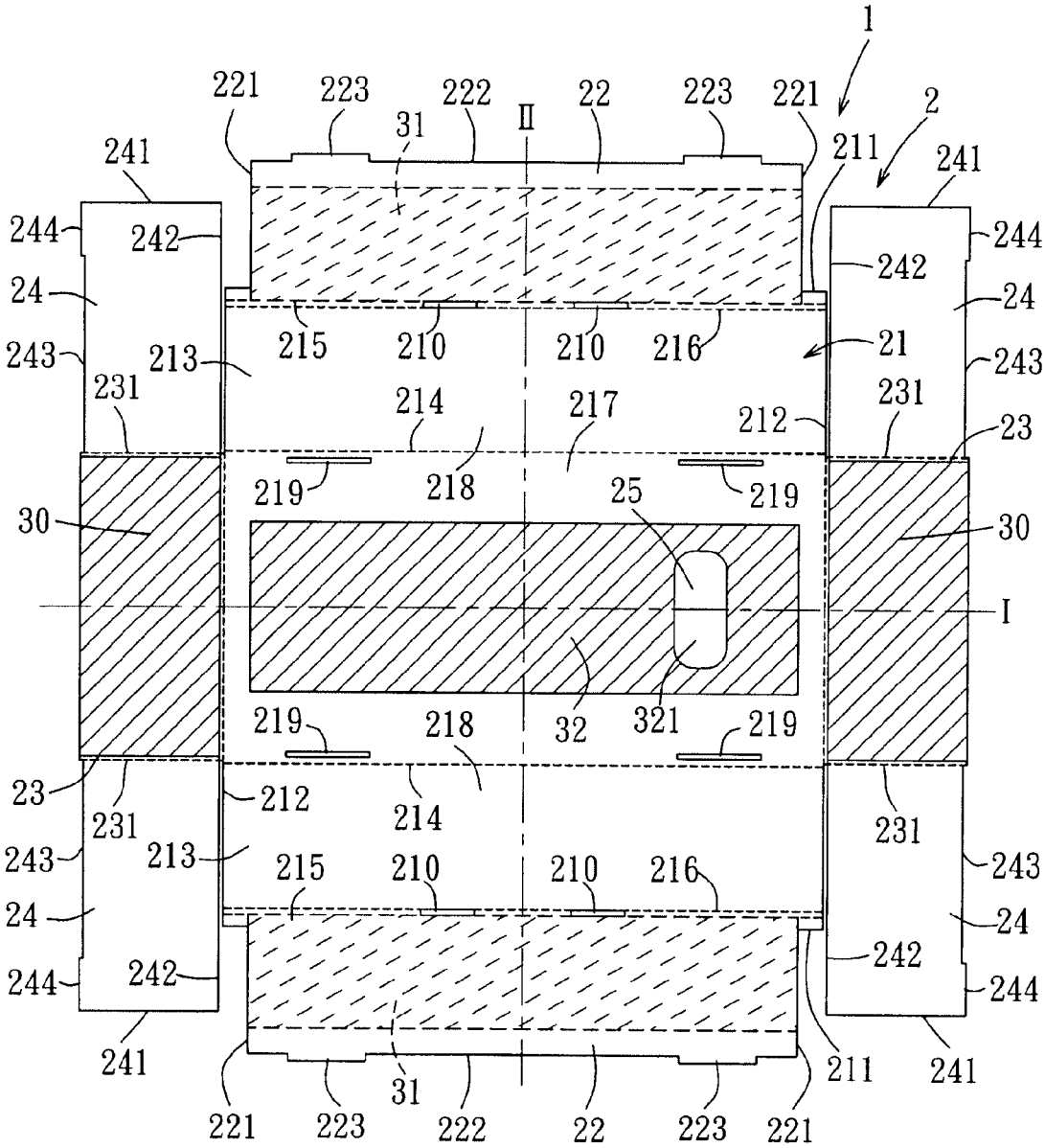
FIG. 10 is a schematic view illustrating a packaging cushion according to the second preferred embodiment of the present invention, the packaging cushion being in an unfolded state.
Figure 11:
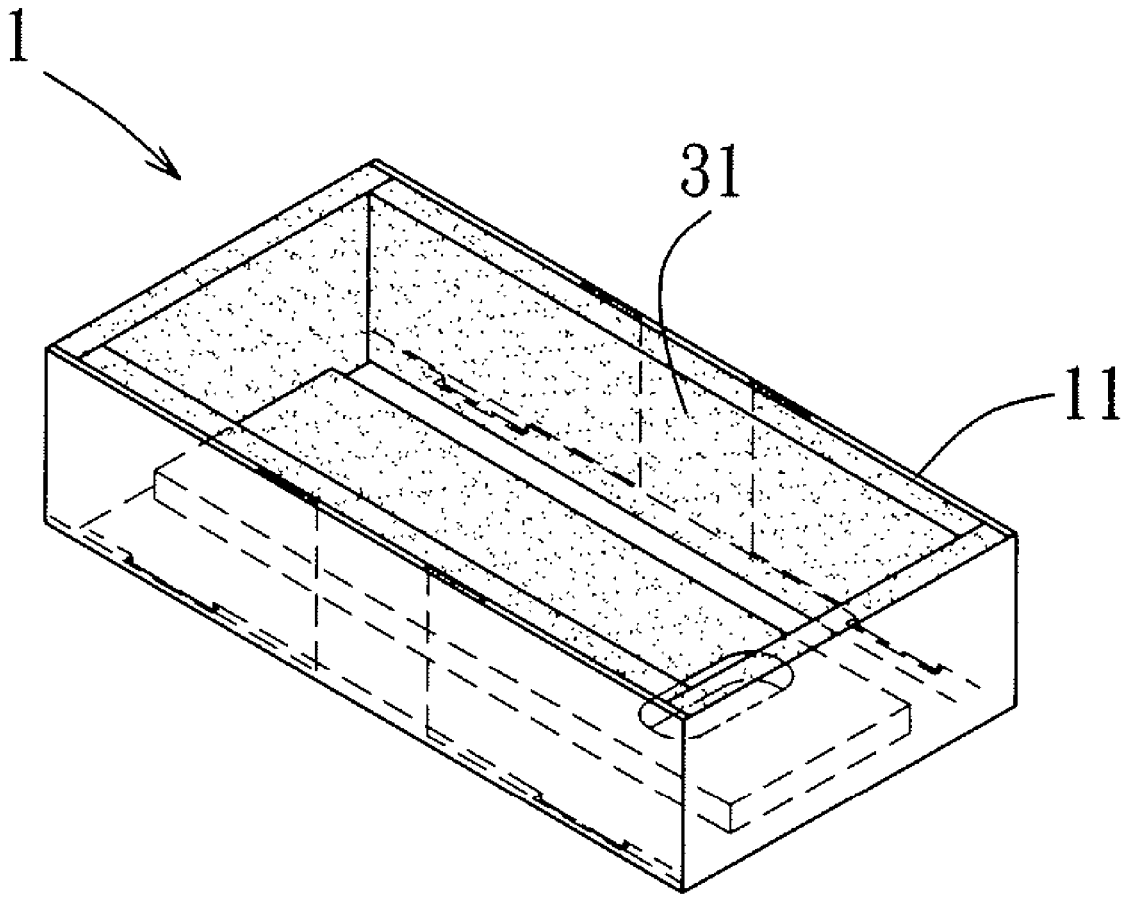
FIG. 11 is a schematic view showing the second preferred embodiment in the first packaging configuration.

Referring to FIGS. 10 and 11, there is shown a second preferred embodiment of the present invention which is substantially similar to the first preferred embodiment except the different position of the soft plates 31 provided on the first extension parts 22. The positions of the soft plates 31 on the paperboards 2 in the first and second preferred embodiments are opposite to each other. Therefore, when the packaging cushion 1 of the second preferred embodiment is in the first packaging configuration, the soft plates 31 thereof are disposed at the inner side of the four-sided surrounding wall 11.

As mentioned hereinabove, the packaging cushion 1 of the present invention can be laid flat so that a plurality of the packaging cushions 1 can be stacked closely together within a cargo container to efficiently utilize an internal space of the cargo container. As such, the quantity of products that can be carried by a single cargo container can be increased, and the transportation costs can be saved. On the other hand, the packaging cushion 1 can be formed into different packaging configurations through simple folding actions so as to provide protection for computer housings. Therefore, the objectives of the present invention are assuredly achieved.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A packaging cushion comprising:

a foldable paperboard that includes: a substantially rectangular main portion having a set of substantially parallel first sides, a set of substantially parallel second sides, two opposite first and second faces, an imaginary first reference line substantially parallel to said first sides and passing through a geometric center of said main portion, an imaginary second reference line substantially parallel to said second sides and passing through the geometric center of said main portion, said first face having two first fold lines disposed in parallel to and respectively on two sides of said first reference line and spaced apart from said first reference line substantially by equal distances, two second fold lines each extending in parallel to and between one of said first sides and one of said first fold lines and proximate to the respective one of said first sides, two third fold lines each extending between one of said first fold lines and one of said second fold lines and proximate to the respective one of said second fold lines, a first region defined between said first fold lines, and two second regions each defined between one of said first fold lines and one of said first sides;

two first extension parts extending respectively from said first sides in a direction substantially parallel to said second reference line, and each having two first short sides substantially parallel to said second reference line, and a first long side interconnecting free ends of said first short sides, said first short sides being offset from extension lines of said second sides of said main portion by a distance so that said first long side has a length smaller than that of said first sides of said main portion;

two second extension parts extending respectively from a portion of said second sides between said first fold lines in a direction substantially parallel to said first reference line, and each having two second short sides substantially parallel to said first reference line; and four wings each extending from one of said second short sides in a direction substantially parallel to said second reference line, and each having a third short side substantially parallel to said first reference line and opposite to the respective one of said second short sides, a third side spaced apart from an adjacent one of said second sides by a clearance, and a fourth side opposite to said third side; and a plurality of soft plates respectively attached to said first extension parts, said second extension parts, and said first region of said main portion;

wherein the packaging cushion can be formed into a first packaging configuration in which said second extension parts are bent by right angle toward said first face and along said second sides, said wings are bent by right angle along said second short sides to extend respectively along directions of said first fold lines, said second regions together with said first extension parts are bent by right angle toward said first face along said first fold lines, and said first extension parts together with parts of said main portion are bent by 180 degree along said second and third fold lines so that two of said wings are placed between a respective one of said first extension parts and a respective one of said second regions wherein said fourth side of each of said wings has a second tab, each of said second regions of said main portion having a plurality of second insert slots between said second and third fold lines to match said second tabs of said wings, whereby said second tabs engage said second insert slots, respectively, when said packaging cushion is in said first packaging configuration.

2. The packaging cushion of claim 1, wherein each of said first, second, third short sides of said paperboard has a length substantially equal to a distance between said first and third fold lines provided in said second regions of said main portion.

3. The packaging cushion of claim 1, wherein said first long side of each of said first extension parts has a plurality of first tabs, said first region of said main portion having a plurality of first insert slots to match said first tabs, whereby said first tabs engage said first insert slots, respectively, when said packaging cushion is in said first packaging configuration.

4. The packaging cushion of claim 2, wherein said first long side of each of said first extension parts has a plurality of first tabs, said first region of said main portion having a plurality of first insert slots to match said first tabs, whereby said first tabs engage said first insert slots, respectively, when said packaging cushion is in said first packaging configuration.

5. The packaging cushion of claim 1, wherein each of said second tabs is located proximate to a respective one of said third short sides.

6. The packaging cushion of claim 1, wherein said first region of said main portion has a handling hole, one of said soft plates provided on said first region of said main portion having a through hole aligned and communicated with said handling hole.

7. The packaging cushion of claim 1, wherein said soft plates are provided on a same face of said paperboard.

8. The packaging cushion of claim 7, wherein said soft plates are provided on said first face of said paperboard.

9. The packaging cushion of claim 1, wherein the packaging cushion is formed into a second packaging configuration in which one of said first extension parts is unfolded.

10. The packaging cushion of claim 9, wherein said soft plates are provided on said first face of said paperboard.

11. A packaging cushion assembly for use in packaging a computer module or a computer housing that has a front panel side, and a rear side, the packaging cushion assembly comprising two packaging cushions each of which has a combination as recited in claim 1, said two packaging cushions being adapted to cover the front panel side and the rear side, respectively.

* * * * *